US005167358A

United States Patent [19]

Bihler et al.

[11] Patent Number: 5,167,358

[45] Date of Patent: Dec. 1, 1992

[54] MATERIAL LOADING APPARATUS FOR MATERIAL WORKING MACHINES

[75] Inventors: Otto Bihler, Halblech, Fed. Rep. of Germany; Eduard Brüller, Trimbach, Switzerland

[73] Assignee: Otto Bihler Maschinenfabrik GmbH & Co.KG, Halblech/Fussen, Fed. Rep. of Germany

[21] Appl. No.: 545,916

[22] Filed: Jun. 28, 1990

[30] Foreign Application Priority Data

Jul. 4, 1989 [DE] Fed. Rep. of Germany ..... 3921997

[51] Int. Cl.[5] ..... B65H 20/22; F16H 21/32

[52] U.S. Cl. ..... 226/158; 74/40; 226/159; 226/162; 226/165

[58] Field of Search ..... 226/158, 159, 161, 162, 226/163, 165; 74/40

[56] References Cited

U.S. PATENT DOCUMENTS

| | | | |
|---|---|---|---|
| 3,784,075 | 1/1974 | Partmann | 226/163 X |
| 4,167,239 | 9/1979 | Bihler | 226/162 X |
| 4,580,710 | 4/1986 | Ledgerwood | 226/162 X |

FOREIGN PATENT DOCUMENTS 2631193 1/1978 Fed. Rep. of Germany .

2035865 6/1980 United Kingdom .

*Primary Examiner*—Daniel P. Stodola
*Assistant Examiner*—P. Bower
*Attorney, Agent, or Firm*—Brumbaugh, Graves, Donohue & Raymond

[57] ABSTRACT

A material loading apparatus for material working machines comprises loading slide elements for stepwise conveying one of a wire and strip material guided in a main guide along a guidance direction. The loading slide elements having a controlled slide-mounted material clamping device, an oscillating drive connected to the loading slide elements and a controlled material holding device. Stopping of the material clamping device at its extreme positions along the main guide is achieved via slide abutments. A resilient transmission system is provided in the driving connection between the oscillating drive and the slide-mounted clamping device. The loading slide elements have, in connection with oscillating drive, a main slide guided in a main guide and a secondary slide provided on the main slide and capable of moving substantially parallel to the main guide. The secondary slide is connected to the main slide, with at least a part of the resilient transmission system disposed between the main and secondary slides.

27 Claims, 4 Drawing Sheets

MATERIAL LOADING APPARATUS FOR MATERIAL WORKING MACHINES

BACKGROUND OF THE INVENTION

The invention relates to a material loading apparatus for material-working machines, especially automatic wire and tape stamping and bending machines comprising—guided in a main guide—loading slide means with a controlled slide mounted material clamping device, an oscillating drive which is connected to the loading slide means, and a controlled material holding device, stoppage of the slide mounted material clamping device in its extreme positions along the main guide being determined by slide abutments, a resilient transmission system provided in the driving connection between the oscillating drive and the slide mounted material clamping device.

STATEMENT OF THE PRIOR ART

Such a material loading apparatus is known, for example from DE-OS 27 41 149; c.f., for example, FIG. 5 in conjunction with page 8, last paragraph, and page 9, first paragraph, thereof.

In the case of the prior art material loading apparatus, the entire mass of the loading slide has to be abruptly braked when the loading slide encounters the one or the other of the slide abutments. It is necessary also to add to the mass of the slide a part of the drive connection which connects the slides to the oscillating drive.

DE-OS 27 41 149 discloses measures which make it possible to modify the pattern of movements of the loading slide, for example, by superimposing on a sinusoidal pattern of movements derived from a connecting rod drive a correcting movement which is derived from the third harmonic of the sine pattern derived from the oscillating drive. In this way, it is possible to shorten the loading time needed to advance the strip or wire material and accordingly, then, a longer dwell time of whichever portion of strip or wire is to be machined can be made available. Despite the flattening of the peaks of the modified sine curve of the loading slide, however, it is necessary also with this construction for the slide to encounter abutments since of course during machining of the relevant wire or strip portion it is essential that the wire or strip portion remain absolutely stationary and this can only be achieved with the necessary precision of for example ±0.01 mm by offering an abutment to the loading slide. Also taking into account the modified pattern of movements of the loading slide in accordance with, say, DE-OS 27 21 149, the shocks which occur upon impact of the loading slide are still considerable and the faster the material-working machine is running, the more unpleasant these shocks are. On the other hand, the tendency to run material-working machines increasingly faster is still present as it always has been.

OBJECT OF THE INVENTION

The invention is based on the problem of reducing the impact energy which has to be absorbed at any given moment when the loading slide means strike the slide abutments.

SUMMARY OF THE INVENTION

In order to resolve this problem, it is according to the invention proposed that the loading slide means comprise, connected to the oscillating drive, a main slide which is guided in the main guide and that there is on the main slide and substantially parallel with the guidance direction of the main guide a secondary guide and that, guided on this secondary guide there is a secondary slide, and that the secondary slide carries the slide-mounted material clamping device, and that the secondary slide cooperates with the slide abutments and in that at least a part of the resilient transmission means is disposed between the secondary slide and the main slide.

Therefore, the invention follows a basically different path than that indicated in DE-OS 27 21 149 in that it makes no attempt to bring the curve representing the loading slide movement still closer to an ideal form, possibly a trapezoidal form, but in accordance with a first embodiment aims to reduce the mass which strikes the slide abutments.

The energy which has to be absorbed instantly upon impact upon the slide abutments can be arrived at from the following equation $$E=m*v^2$$

in which

E is the impact energy, m is the mass striking the relevant abutment and v is the linear velocity of the striking mass at the moment of impact.

From the following relationship, it can be seen that the energy E which has to be dissipated is proportional to the mass, i.e. the smaller the mass m, the smaller the energy will be.

By reducing the mass, the risk of the loading slide means rebounding on the abutment is reduced. Furthermore, the violent development of noise is diminished. Furthermore, wear and tear on the abutments themselves and on the parts which are exposed to the shock are reduced. Finally, the accuracy of loading is increased and this is a function of the energy to be absorbed under any given circumstance and the smaller the amount of energy which has to be absorbed, the greater the loading accuracy will be.

The above-mentioned solution according to the invention is based on the consideration that the mass of the slide required to achieve a clean linear guidance for entraining whatever material has to be machined is not altogether necessary and that it is therefore possible to keep the mass of the secondary slide relatively small compared with the mass of the main slide. In practice, it has been shown that the mass of the secondary slide can be reduced to a fraction of the mass of the total represented by the main slide and secondary slide, for example to 10%–15% of the total masses of main slide and secondary slide. Naturally, although the resilient transmission system between the secondary slide and the main has to be strong enough to accelerate the mass of the additional slide in order to accelerate the wire or strip material and possibly in order to move the wire or strip material through a straightening device, the subdivision of the loading slide according to the invention into a main slide and a secondary slide ensures a substantial reduction in the energy to be absorbed at the relevant slide abutments. The parts of the spring means located between the secondary slide and the main slide are preferably subjected to pre-tension which already exists in the state of rest, in order to be able to transmit the forces which have to be applied to the secondary slide.

Naturally, it is necessary to mount on the secondary slide the essential parts of the material clamping device, in other words: two clamping surfaces of which one may as a rule be rigid with the secondary slide while the other must be capable of a clamping and releasing movement in respect of the former. In contrast, the not inconsiderable masses which are required for controlling the material clamping device at the slide end are to a substantial degree shifted from the secondary slide away to the main slide so that the mass of the secondary slide can be still further reduced. This applies regardless of how the material clamping device on the slide side is controlled, in other words independently of whether the clamping control for the material clamping device on the slide side is a purely mechanical, an hydraulic or an electricla control system.

If the material clamping device at the slide end, as already indicated above, is a clamping station which is rigid with the secondary slide and if it comprises a clamping member which is capable of a clamping movement and which is mounted on the secondary slide, then it is possible to mount on the main slide a pressure-applying member which can be entrained thereby lengthwise of the main guide and which is intended to act on the clamping member and which is capable of a relative movement in respect of the clamping member along the main guide. For example, the pressure-applying member which is moved together with the main slide can simply be caused to act via a sliding surface on the clamping member mounted on the secondary slide.

The resilient transmission system between the secondary slide and the main slide can be most easily so configured that the secondary slide is clamped on the main slide between two transmission springs acting in opposite directions and parallel with the main guide and—as already stated above—these transmission springs are preferably subject to pre-tension when in the position of rest.

With this solution, therefore, only the mass of the secondary slide is included into the acceleration equation set out earlier, but not the mass of the main slide and the masses of the parts which are directly coupled to the main slide for movement together therewith. No longer does the main slide travel up to the slide abutments but fulfils its travel unhampered by the abutments. The relative distance between the main slide and the secondary slide is dependent upon the type of drive chosen for the oscillating drive. This oscillating drive can for example be carried out with an eccentric member or with a cam plate. In each case, modified drives may be used, such as are used for example in DE-OS 27 41 149, but also for example in DE-OS 28 50 944.

In a further development of the invention, it is suggested that at least a part of the loading slide means and in particular at least the secondary slide be adapted to be braked prior to striking a slide abutment. Applied to this previously dealt with embodiment with a main slide and secondary slide, this means that the secondary slide is decelerated with a relative shift in respect of the main slide before it strikes a slide abutment.

If the equation already set out above is considered again in terms of the final energy to be absorbed upon impact against a slide abutment $$E=m*v^2,$$

then it can be seen that by braking the speed inherent in the loading slide shortly before impact of the loading slide against the slide abutment, this energy can be reduced by the square on the linear speed and that therefore it is possible greatly to reduce the amount of energy to be absorbed at a given time. If there is provision for the loading slide means to be separated into main slide and secondary slide, as already mentioned above, then this means that the energy to be absorbed at any given moment upon impact of the secondary slide on the slide abutment will on the one hand by reduction of the mass to the mass of the secondary slide and on the other by the reduction of the velocity according to the aforementioned equation will be reduced. According to a preferred embodiment of the invention, for braking the secondary slide, a proximity sensor is provided which, when the secondary slide draws close to the slide abutment, enters into a reciprocal action with a sensor engaging surface rigid with the slide abutment, the said proximity sensor acting on the secondary slide, braking its rate of approach to the respective abutment. Basically, it is possible to provide the proximity sensor directly on the secondary slide. According to a preferred embodiment of the speed-reducing principle in its application to the mass-reducing secondary slide principle, there is nevertheless provision for the proximity sensor to act on the secondary slide via a sensor transmission which is supported on the main slide. The sensor transmission can thereby be of such a shape that the proximity sensor is mounted to pivot on one arm of an angle lever mounted pivotally on the main slide, another arm of this angle lever acting on the secondary slide.

In order to avoid a shock being generated on the sensor engaging surface when the sensor starts to act, the problem on which the invention is based being actually to avoid this, it is proposed that the sensor engaging surface which is rigid with the abutment should be inclined at an acute angle to the direction of guidance of the main guide. The smaller the angle between the sensor engaging surface and the direction of guidance of the main guide, the less the shock effect is or, in other words, the less the amount of energy which has to be absorbed at any given moment when the proximity sensor encounters the sensor engaging surface which is rigid with the abutment. The sensor engaging surface can thereby be inclined over its entire engagement length with a constant angle of inclination to the direction of guidance of the main guide. It is however also conceivable to construct the sensor engaging surface as an engaging path, the inclination of which in respect of the main guidance direction increases with increasing duration of engagement between proximity sensor and sensor engaging surface, so that the delay effect becomes greater with diminishing speed of the loading slide means, and more particularly the secondary slide, and the energy absorption is therefore distributed almost evenly over a specific braking path. The sensor engaging path then assumes a curved form which deviates from the linear pattern.

Since the problem of rebound, due to instantaneous energy absorption, arises at each end of the movement of the reciprocating loading slide means, in other words: particularly of the secondary slide if the loading slide means is divided into main slide and secondary slide, it is recommended that a proximity sensor be associated with each of the slide abutments.

Braking of the loading slide means or—in the case of the example where the loading slide means is subdivided into main and secondary slides—of the secondary slide can be a purely elastic braking. It is however also conceivable that the braking should be non-elastic, i.e. that an energy-dissipating braking member should be incorporated, possibly in the form of an energy-dissipating hydraulic jet.

With regard to the subdivision of the loading slide into a main slide in the secondary slide, the main slide after impact of the secondary slide on the relevant slide abutment performs a relative follow-up movement vis-a-vis the secondary slide regardless of whether there is provision for a braking of the impact velocity or not. This relative follow-up movement can according to a further development of the invention be used for controlling the clamping device which is on the slide side, more or less so that controlling of the clamping device on the slide side is derived from the relative follow-up movement of the main slide vis-a-vis the secondary slide and which acts after the secondary slide has struck the relevant slide abutment. The relative follow-up movement then so to speak constitutes the control signal for the clamping device on the slide side. This signal can be used in all manner of ways to actuate the slide-side clamping device, and may for example be hydraulic but possibly even purely mechanical.

A purely mechanical controlling of the clamping device can for example be carried out in that for controlling the material clamping device a clamping wedge is provided which is adapted to be clamped or released by the relative follow-up movement. The solution which employs a clamping wedge can most easily be carried into effect in that the clamping wedge is disposed between a clamping member mounted on the secondary slide and forming part of the clamping device which is rigid with the slide on the one hand and a wedge abutment surface provided on the secondary slide and cooperating with wedge-actuating abutments on the main slide which engage it in the direction of guidance of the main guide.

The clamping device on the slide side ought preferably to be spring-mounted in order not to produce any clamping of the wire or strip material which might lead to material damage. Applied to the clamping wedge solution, this means that of the wedge actuating abutments, at least that one may be spring mounted which produces clamping of the clamping device which is rigid with the slide.

Where material loading apparatuses are concerned, it is necessary that the material should also be supported when the loading slide has completed its forward travel which feeds the material to the relevant machining station and is moving backwards again during the further course of the oscillating movement imparted to it by the oscillating drive. It is this purpose which is served by the so-called material holding device. If, then, a relative follow-up movement of the main slide in respect of the secondary slide is available whenever the secondary slide has encountered an abutment, then it becomes possible also for the material holding device to be controlled by the relative follow-up movement of the main slide in respect of the secondary slide which takes place when the secondary slide strikes the relevant slide abutment. In practice, this controlling of the material holding device may be carried into effect in that the main slide comprises a holding device control abutment which acts on the holding device controlling transmission. In order to be able to release and clamp the material holding device according to the movement phase of the oscillating drive, triggered in each case by a signal given by the relevant relative follow-up movement, it is furthermore proposed that the main slide comprise two holding device controlling abutments of which, according to the direction of movement of the main slide, so one or other acts on the holding device controlling transmission in opposite directions.

The holding device controlling transmission can be constructed in an extremely simple way with a linkage extending in the direction of guidance of the main guide and provided with, on the linkage side, mating abutments intended to be acted upon by the holding device controlling abutments.

Also the holding device controlling transmission can in turn act on the material holding device via a clamping wedge device, whereby for protective treatment of the material, it is possible also here in the region of the holding device control or in the region of the clamping wedge to provide a resilient intermediate member.

If there is provision for decelerating the secondary slide before it strikes the relevant slide abutment, then the position of the sensor engaging surface is regularly stationary compared with the position of the relevant slide abutment. This permits of simplified machine adjustment in that the switch engaging surface rigid with the abutment is unalterably connected to the relevant slide abutment.

A further simplification of the machine adjustment can be achieved if there is a controlling transmission for controlling the material holding device as a function of the respective relative follow-up movement of the main slide in that the slide abutments are connected to adjusting abutment surfaces which serve for adjustment of those mating abutments which are at the control transmission end of the linkage.

Naturally, it must be possible to adjust a machine to various drawing-in or loading strokes so that the loading stroke can be adjusted to the length of however much wire or strip is required to constitute a portion. On the side of the oscillating drive, this adjustment is brought about by varying the eccentricity if an eccentric drive is involved or by exchanging the cam plate if the drive is cam operated; alternatively, it is also conceivable to change the transmission ratio of a transmission lever incorporated between the oscillating drive and the main slide. Naturally, it is correspondingly also necessary to adjust the distance between the slide abutments. Correspondingly, it is envisaged that at least one of the slide abutments should be displaceable and lockable in the guidance direction of the main guide.

So that the material to be worked is maintained under full positional control at every phase of the loading movement and during handling, it is envisaged that the material clamping device and the material holding device be so controlled that the material to be fed is at every moment during operation gripped by at least one of these devices.

BRIEF DESCRIPTION OF THE DRAWINGS

Examples of embodiment of the invention are explained in greater detail hereinafter with reference to the accompanying drawings, in which.

DETAILED DESCRIPTION OF THE PREFERRED EMBODIMENTS

Figures 1, 1A:
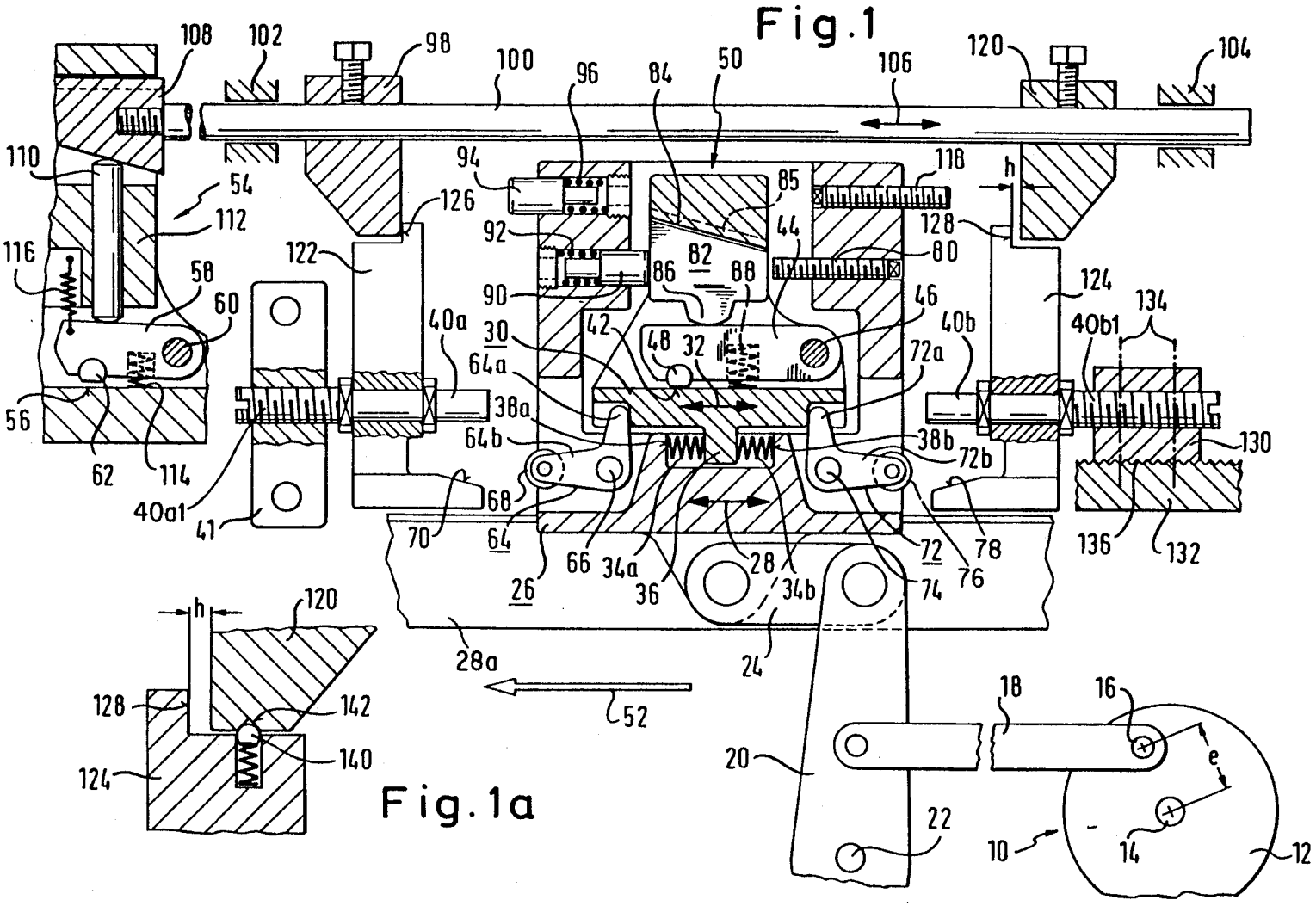
FIG. 1 shows a material loading apparatus according to the invention in which the loading slide is subdivided into a main slide and a secondary slide and in which furthermore there is a braking of the secondary slide and in which finally also the control of the material clamping device and of the material holding device is derived from the relative follow-up movement of the main slide vis-a-vis the secondary slide.
FIG. 1*a* is a detail from FIG. 1.

FIG. 1 shows an oscillating drive 10. It comprises, driven by the main shaft of a bending machine, an eccentric disc 12 which rotates continuously and at a constant rotary speed about a spindle 14. Mounted on the eccentric disc 12 is an eccentric journal 16 of variable eccentricity e. From the eccentric journal 16, a connecting rod 18 extends to a pivot lever 20 which is driven by the connecting rod so that it oscillates about a pivot axis 22. The pivot lever 20 is connected in driving fashion to a main slide 26 by an articulating link 24. The main slide 26 is guided in rectilinear fashion in the direction of the double-headed arrow 28 on a main guide 28*a* which is not shown in greater detail. A secondary slide 30 is guided in the direction of the double-headed arrow on the main slide 26 in a secondary guide which is not shown in greater detail. The secondary guide of the secondary slide 30 is parallel with the main guide 28*a* of the main slide 26 and enables the secondary slide (30) to move along a secondary guidance direction (32).

Figure 4:
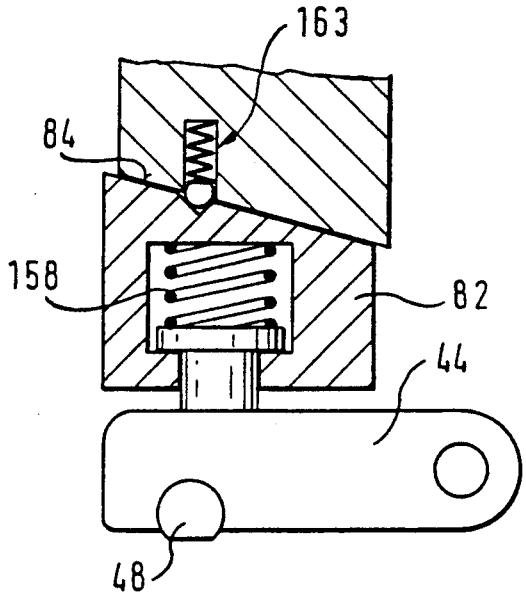
FIG. 4 shows a third modified form of control for the material clamping device.

The secondary slide 30 is driven by being connected to the main slide 26 through two transmission springs 34*a* and 34*b* which will be dealt with in greater detail in connection with FIG. 4. The transmission springs engage a projection 36 on the secondary slide 30 and are biased on thrust surfaces 38*a* and 38*b* of the main slide 26. The two transmission springs 34*a* and 34*b* are subject to pre-tension when the material loading apparatus is in its position of rest.

When the eccentric disc 12 is rotating, then the main slide 26 is reciprocated in the direction of the double-headed arrow 28 and the secondary slide is entrained by the transmission springs 34*a* and 34*b*. Rigidly mounted on a stationary frame on the bending machine are abutments 40*a* and 40*b*. The abutments 40*a* and 40*b* are provided with lockable adjusting means 40*a*1 and 40*b*1 for adjusting the abutments 40*a* and 40*b* in the direction of guidance 28 of the main guide 28*a*. Before the main slide 26 reaches its extreme left-hand position indicated in FIG. 1, the secondary slide 30 abuts the slide abutment 40*a* so that the secondary slide 30 comes to a standstill and the main slide 26 continues the movement imposed upon it by the oscillating drive 10 leftwardly so that the transmission spring 34*b* becomes compressed. Therefore, there is a relative follow-up movement of the main slide 26 in relation to the secondary slide 30.

If on the other hand the main slide 26 is moved rightwardly in the direction of the double-headed arrow 28 under the driving effect of the oscillating drive 10, then the secondary slide 30 abuts the slide abutment 40*b* before the main slide 26 reaches its right outermost position in FIG. 1. There is then again a relative follow-up displacement of the main slide 26 in respect of the secondary slide 30, this time to the right; during this relative follow-up movement, the transmission spring 34*a* becomes compressed.

It can be seen from the description thus far that of the total mass of the two slides, i.e. that of the main slide 26 and of the secondary slide 30, it is in each case only a part, namely the mass of the secondary slide 30, which strikes the abutments 40*a* or 40*b*. Thus, the energy which has to be absorbed upon the relevant impact at any given time is substantially reduced in respect of the energy which would have to be absorbed were the two slides 26 and 30 connected rigidly to each other and if their total mass were to strike the abutment 40*a* or 40*b*.

The secondary slide 30 is responsible for drawing in the material. Mounted on the secondary slide 30 is a clamping surface 42 rigid with the secondary slide and also a clamping member 44 in the form of a clamping lever 44 which is mounted on the secondary slide 30 to pivot about a pivot bearing 46. The material to be drawn in or loaded, in other words a strip or a wire, can be clamped between a clamping projection 48 on the clamping lever 44 on the one hand and the clamping position 42 on the other. The clamping and releasing movement of the clamping lever 44 is brought about by a clamping control 50 which will be dealt with in greater detail later. At the moment the following will be sufficient: loading of the wire or strip to be processed in the wire or strip bending machine takes place from right to left in FIG. 1, in the direction of the arrow 52. When the secondary slide 30 is in its extreme right-hand position, in other words the position it bears against the slide abutment 40*b*, the clamping projection 48 is pressed downwards by the clamping control 50 with the result that the wire or strip material is clamped between the clamping projection 48 and the clamping position 42. If, then, the secondary slide 30 is moved from right to left, then the wire or strip material is entrained by the secondary slide 30 until it arrives in the extreme left-hand position of the secondary slide 30, i.e. in the position of the secondary slide 30 which is defined by the slide abutment 40*a*. Therefore, by virtue of its structure and its pre-tension, the transmission spring 34*b* must be strong enough to pull the wire or strip stock from a supply roll, pulling it through a straightening apparatus and accelerating it in the process to match the movement of the main slide 26; further comments concerning this are given in connection with FIG. 6.

When the secondary slide 30 has reached its extreme left-hand position in FIG. 1, which is defined by the slide abutment 40*a*, the clamping control 50 becomes effective in the sense of releasing the clamping on the wire or strip material so that during the subsequent return stroke of the secondary slide 30 from left to right, the strip or wire material remains in position.

At this juncture, it should be mentioned that the time required to advance the wire or strip material through the secondary slide 30 in the direction of the arrow 52 is described as the "drawing-in" or "loading" time. This loading time is not available for the bending and stamping operations which are to be performed on the wire or strip material. Instead, only the stoppage time is available for the bending and stamping. It is therefore desirable for the drawing-in time to be as short as possible while on the other hand the stoppage time during the course of one movement cycle should be as long as possible, i.e. the longest possible time should be available for the bending and stamping operations. The stoppage time starts when the secondary slide 30 has reached its extreme left-hand position by striking the slide abutment 40*a* and finishes when the next feed movement starts.

It must also be mentioned here that the strip or wire material must also be subject to position verification during the stoppage time. For this purpose, a material holding device 54 is provided which is rigidly disposed on the stamping and bending machine. This material holding device likewise comprises a clamping position 56 and a clamping member 58 in the form of a clamping lever. The clamping member 58 is pivotable about a pivot bearing 60 and comprises a clamping projection 62 so that the wire or strip material is clamped between the clamping projection 62 and the clamping position 56 during the stoppage time, i.e. while the material is being machined by the bending and stamping tools. So that the position of the wire or strip material remains controlled at any time during operation, it is necessary for either the clamping device 42, 48 at the slide end or the material holding device 56, 62 to be clamped at every moment. This means that when the secondary slide 30 arrives at its extreme left-hand position in FIG. 1, firstly the material holding device 56, 62 must grip the wire or strip material in a clamping manner and only then, but if at all possible shortly afterwards, may the material clamping device 42, 48 which is on the slide side be released. On the other hand, once the secondary slide 30 has reached its right-hand extreme position defined by the slide abutment 40*b* it is necessary firstly that the clamping device 42, 48 clampingly grip the strip or wire material, the material holding device 56, 62 only then being released.

Figure 2:
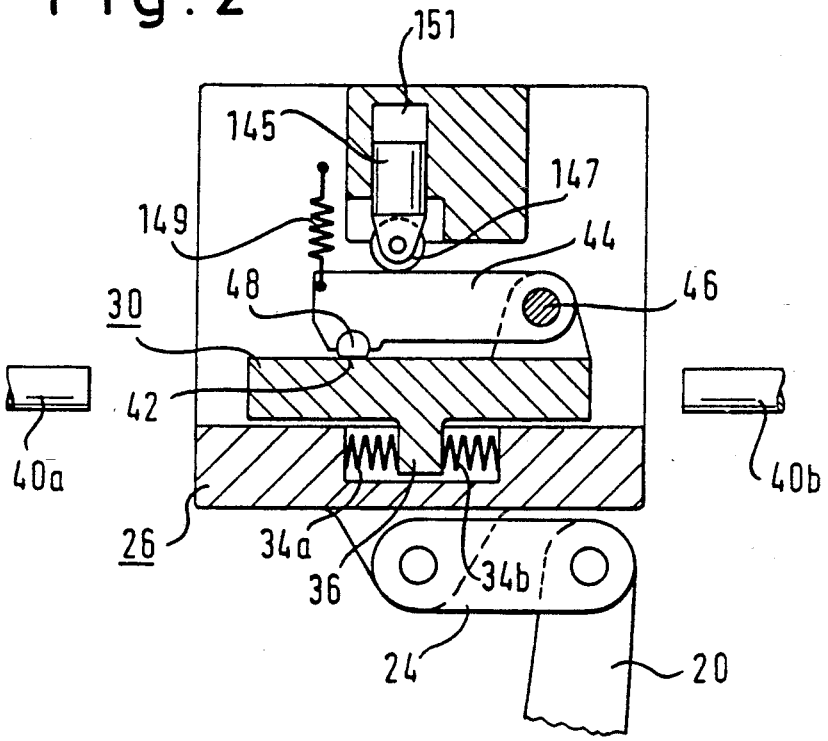
FIG. 2 shows a first modified embodiment of control for the material clamping device.

The oscillating drive 10 may be constructed as described in DE-OS 27 41 149, possibly in FIG. 2 thereof; this means that the pattern of movements of the main slide 26 may, in comparison with a sine curve, be modified in that the apex of the sine curve is flattened and the flanks of the curve are made steeper. Nevertheless, the secondary slide 30 strikes the slide abutments 40*a*, 40*b* at a considerable speed so that at the moment of impact a considerable amount of energy has to be absorbed, although the striking mass of the secondary slide 30 is already considerably reduced compared with a prior art solution in which the clamping device 42, 44 is mounted rigidly on the main slide. The energy to be absorbed momentarily when the secondary slide 30 strikes the slide abutment 40*a* or 40*b* arises essentially from the mass of the secondary slide 30 and from the impact velocity of the secondary slide 30 on the abutment 40*a* or 40*b*.

Hereinabove, it has been stated that the energy to be absorbed momentarily is governed by the following equation:

$$E = m * v^2$$

in which

E is the energy to be dissipated momentarily, m is the mass of the secondary slide and v is the impact velocity of the secondary slide against the slide abutment 40*a* or 40*b*.

In the foregoing description, it has been stated that by subdividing the loading slide into the main slide 26 and the secondary slide 30, the energy E has already been substantially reduced, because the mass m is essentially determined by just the mass of the secondary slide 30. In order to make the energy to be dissipated momentarily even less, it is stated hereinafter that also the impact velocity v is reduced.

Mounted on the main slide 26 to pivot about a pivot bearing 66 is an angle lever 64. This angle lever 64 has one lever arm 64*a* which engages the secondary slide 30 and carries on its other lever arm 64*b* a proximity sensor 68 in the form of a sensing roller. Before the secondary slide 30 encounters the slide abutment 40*a* during leftwards movement of the main slide 26, the sensor roller 46 enters into reciprocal action with a sensor engaging surface 70 disposed on the stamping and bending machine in a positionally-invariable relationship with the slide abutment 40*a* which is rigidly fixed by a clamping device 41. The sensor engaging surface 70 subtends with the direction 32 of the main guide 28 a small acute angle of for example 20°, as can be seen from FIG. 1. When the proximity sensor 68 comes into engagement with the sensor engaging surface 70—and as stated this occurs prior to the secondary slide 30 abutting the abutment 40*a*—then the angle lever 64 is pivoted in a clockwise direction and thus the secondary slide 30 is displaced in relation to the main slide 26, to the right in FIG. 1. This displacement movement is superimposed on the speed of the main slide 26 so that the speed of the secondary slide 30 is decelerated in relation to the speed of the main slide. If, then, after all, the secondary slide 30 strikes the abutment 40*a*, then this takes place at a reduced speed so that the impact energy which has to be absorbed momentarily is further reduced in accordance with the formula indicated above.

In order also to decelerate the impact speed of the secondary slide 30 during movement of the main slide from left to right, before the secondary slide 30 encounters the slide abutment 40*b*, a further angle lever 72 is provided with a lever arm 72*a* and a lever arm 72*b*, this angle lever 72 being again pivotable on the main slide about a pivot bearing 74. The lever arm 72*b* carries a further proximity sensor 76 which cooperates with a sensor engaging surface 78 in exactly the same way as indicated previously with reference to the proximity switch 68.

It has been stated hereinabove that the clamping device 42, 48 requires a control 50 and that the material holding device 56, 62 likewise requires control.

In addition, it has been stated hereinabove that the main slide 26, after the secondary slide 30 has struck the slide abutment 40*a*, 40*b*, performs a relative follow-up movement in respect of the secondary slide 30. It will now be stated hereinafter that this relative follow-up movement can be utilised in order to control the material clamping device 42, 48 and for controlling the material holding device 56, 62.

When the secondary slide 30 has encountered the abutment 40*a*, the main slide 26 continues to move leftwardly, for example by an amount of 0.5 to 2.0 mm. Then, the material clamping device 42, 48 must be released. When the secondary slide 30 has encountered the slide abutment 40*a* and the main slide 26 has moved farther leftwardly, a wedge actuating abutment 80 provided on the main slide 26 strikes a clamping wedge 82 which is part of the clamping control 50. This clamping wedge 82 is gripped between a wedge-bearing surface 84 on the secondary slide 30 and the clamping member 44 and is guided on the secondary slide 30 by a guide 85. When, now, the wedge-actuating abutment 80 encounters the clamping wedge 82, this latter is displaced leftwardly in relation to the wedge-bearing surface 84, i.e. by reason of the leftwardly and upwardly extending configuration of the wedge-bearing surface 84, it is able to move aside in an upwards direction. Consequently, the clamping wedge projection 86 mounted on the clamping wedge 82 is lifted off the clamping member 44 and this latter can be lifted off the clamping position 42 under the action of a coil thrust spring 88.

On the other hand, when the secondary slide 30 has encountered the slide abutment 40*b* and the main slide 26 is performing its relative follow-up movement in respect of the secondary slide 30, a wedge-operating abutment 90 provided on the main slide 26 presses on the clamping wedge 82 and seeks to displace it rightwardly. In this, the clamping wedge 82 has to move downwardly by virtue of the rightwardly and downwardly extending angle of the wedge-bearing surface 84, so that it presses the clamping member 44 downwardly so that the wire or strip material is clamped between the clamping projection 48 and the clamping position 42. At this point, it is essential to see that the wedge-operating abutment 90 is biased by a coil thrust spring 92. This coil thrust spring 92 prevents excessively strong clamping of the wire or strip material between the clamping projection 48 and the clamping position 42, which might result in the wire or strip material being damaged.

Also the control of the material holding device 54 can be derived from the relative follow-up movement of the main slide 26 in relation to the secondary slide 30, as will be explained hereinafter.

When the secondary slide 30 has contacted the slide abutment 40*a* and the main slide 26 is performing a relative follow-up movement leftwardly in relation to the secondary slide 30, then it is important for the material holding device 54 to exercise a clamping action and in fact before the clamping action of the material clamping device 42, 48 is relaxed.

Mounted on the main slide 26 is a holding device controlling abutment 94 which is spring-loaded by a coil thrust spring 96. This holding device controlling abutment strikes a mating abutment 98 which is rigidly clamped on a linkage 100. The linkage 100 is guided for displacement in the direction of the double-headed arrow 106 in linear guides 102 and 104 of the stamping and bending machine frame. Mounted on the left-hand end of the linkage 100 is a further clamping wedge 108. This clamping wedge 108 cooperates with a clamping push member 110 which belongs to the material holding device 54. The clamping push member 110 is guided in a block 112 which is rigidly disposed on the frame of the stamping and bending machine. When the holding device controlling abutment 94 comes to bear against its mating abutment 98, the clamping wedge 108 is displaced leftwardly and as a consequence of this the clamping push member 110 is pressed downwardly. Thus, the clamping member 58 with the clamping projection 62 moves close to the clamping position 56 and the wire or strip material is clamped in the material holding device 54. Here again, it must be stressed that this clamping action must take place at 56, 62 before the clamping action in the material clamping device 42, 48 on the slide side is relaxed. This sequence can be achieved by an appropriate adjustment of the abutments 80 and 94 and by corresponding dimensioning of the coil thrust spring 96. The coil thrust spring 96 has the effect of preventing any over-clamping between the clamping position 56 and the clamping projection 62. The clamping lever 58 is pre-tensioned by a coil thrust spring 114 to produce lifting off the clamping position 56 or may be held in constant engagement with the clamping push member 110 by a coil drawspring 116.

When the secondary slide 30 has reached its extreme right-hand position abutting the slide abutment 40*b*, then it is necessary again to release the material holding device 56, 62 although only after the material clamping device 42, 48 on the slide side has taken over clamping of the material. Mounted on the main slide 26 is a further holding device controlling abutment 118 which during the course of the relative follow-up movement of the main slide 26 rightwardly strikes the mating abutment 120 which is rigidly clamped on the linkage 100. When this happens, the linkage 100 is displaced rightwardly and thus the material holding device is released again at 56, 62.

It has already been said that the slide abutments 40*a* and 40*b* are mounted so as to be immovable in relation to the relevant sensor engaging surface 70 or 78, in fact being mounted on a block 122 or 124. These blocks 122 and 124 furthermore comprise adjusting abutment faces 126 and 128 for the mating abutments 98 and 120 and thus for the linkage 100. The control stroke of the linkage 100 is designated h in FIG. 1 in the region of the block 124. This stroke h must always be of the same size so long as the construction of the material holding device 54 remains unaltered. If, after an adjustment of the eccentric journal in its eccentricity e in relation to the axis of rotation 14, the slide abutments 40*a*, 40*b* are adjusted in keeping with the desired travel of the secondary slide 30, then there is also necessarily a corresponding adjustment of the sensor engaging surfaces 70 and 78. The mating abutments 98 and 120 are correspondingly clamped rigidly on the linkage 100. The correct setting of the mating abutments 98 and 120 can be obtained by using a guage for example to adjust the travel h between the adjusting abutment face 128 and the mating abutment 120, once the mating abutment 98 has been brought to bear on the adjusting abutment face 126.

The coarse adjustment of the abutments 40*a* and 40*b* according to the particular choice of eccentricity e can be carried out in that a fixing block 130 carrying the slide abutment 40*b* is rigidly clamped on a frame part 132 by means of fixing screws 134. It is possible for cooperating tooth systems 136 to be mounted on the frame part 132 and the fixing block 130. In order to be able to adjust the dimension h without a gauge, the following procedure may also be adopted: the mating abutment 98 is positioned so that it bears on the adjusting abutment face 126. The mating abutment 120 is released from its clamping hold on the linkage 100. The mating abutment 120 is then displaced until a spring-loaded ball 140 mounted on the block 124 clicks into place in a ball-engaging notch 142 on the mating abutment 120. The mating abutment 120 is then clamped on the linkage 100. This is shown in FIG. 1*a*.

FIG. 2 again shows the main slide 26 and the secondary slide 30 as well as the slide abutments 40*a* and 40*b*. Furthermore, the clamping member 44 in the form of a clamping lever can be seen on the secondary slide 30. Here, the clamping lever is subject to the action of an hydraulically actuated clamping push member 145 which has a clamping roller 147 which acts on the clamping lever 44. A coil drawspring 149 maintains the clamping lever 44 in constant engagement with the clamping roller 147. Also with this embodiment it is naturally possible to control the hydraulic pressure in the hydraulic cylinder 151 as a function of the relative follow-up movements of the main slide 26 in relation to the secondary slide 30. However, other possibilities of control are conceivable. For the rest, parts which are similar to those in FIG. 1 are again provided with the same reference numerals as therein.

Figure 3:
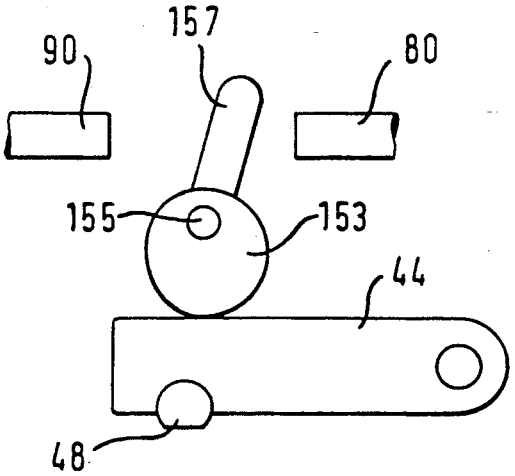
FIG. 3 shows a second modified form of control for the material clamping device.

A further possibility of clamping is shown in highly diagrammatic form in FIG. 3. Here, of the clamping device on the slide side it is only the clamping lever 44 with the clamping projection 48 which can be seen. For controlling the clamping lever 48, an eccentric member 153 is shown and this is mounted on the secondary slide 30 to pivot about an axis of rotation 155. The eccentric member 153 is rigidly connected to a control arm 157. This control arm 157 is adapted for movement against abutments 90 and 80 on the main slide 26. When the abutment 80 is approached by the control arm 157, the eccentric member 153 is pivoted in a direction appropriate to release the material clamping device. If, on the other hand, the abutment 90 is approached by the control arm 156, then the material clamping device is clamped at 48.

Figure 5:
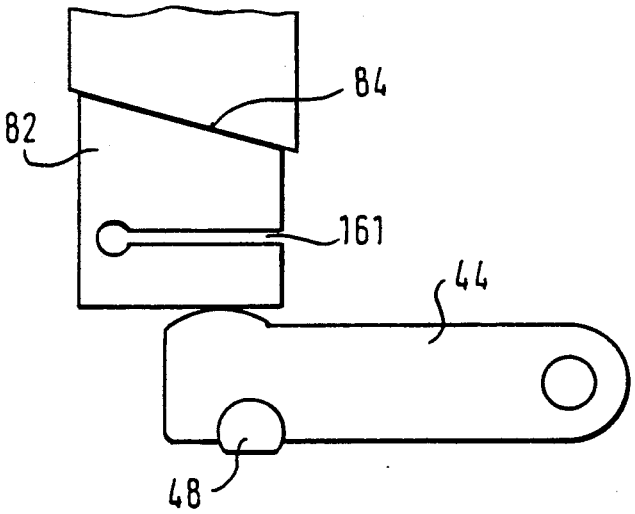
FIG. 5 shows a fourth modified form of control for the material clamping device.

FIG. 4 shows a modified form of the embodiment in FIG. 1 in that a coil thrust spring 158 is provided between the clamping wedge 82 and the clamping lever 44. In this case, the wedge actuating abutment 90 need not be sprung. An associated solution is shown in FIG. 5. Here the clamping wedge 82 is sprung in itself by a slot 161. In order to maintain the clamping action between the clamping wedge 82 and the wedge-bearing surface 84, there is in FIG. 4 a ball catch arrangement 163 which can naturally also be used in the embodiment shown in FIG. 1.

Figure 6:
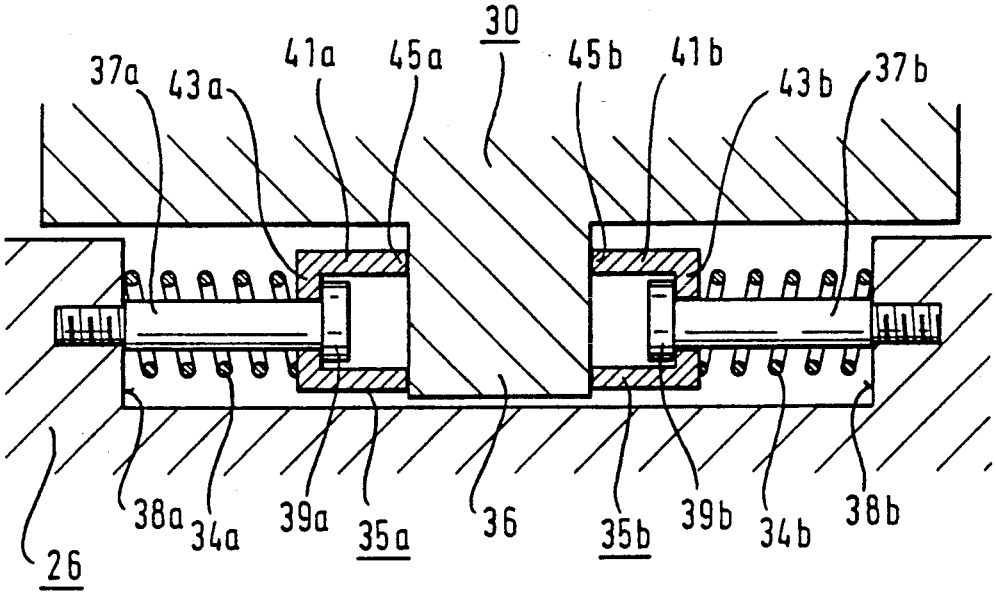
FIG. 6 shows a modified form in relation to FIG. 1 with regard to the resilient transmission means between the secondary slide and the main slide.

FIG. 6 again shows the main slide 26 and the secondary slide 30. Once again there are on the main slide 26 thrust surfaces 38*a* and 38*b* against which the thrust springs 34*a* and 34*b* are supported. Once again these are coil compression springs 34*a* and 34*b*. The coil compression springs 34*a* and 34*b* act on intermediate members 35*a* and 35*b* which in turn bear on the projection 36 on the secondary slide 30. The coil compression springs 34*a*, 34*b* are traversed by compression-maintaining tie rods 37*a*, 37*b* which are anchored in the main slide 26. Mounted on the compression-maintaining tie rods 37*a* and 37*b* are abutment heads 39*a* and 39*b* which are accommodated in sleeves 41*a*, 41*b*. Engaging behind the abutment heads 39*a* and 39*b* are abutment flanges 43*a* and 43*b* of the intermediate members 35*a* and 35*b*. FIG. 6 shows the position of rest of the secondary slide 30 in relation to the main slide 26, in which both coil compression springs 34*a*, 34*b* enjoy maximum relaxation although both are under an initial compression tension. The abutment flanges 43*a* and 43*b* bear on the abutment heads 39*a* and 39*b* and the mutually facing ends 45*a*, 45*b* of the sleeves 41*a*, 41*b* bear on the projection 36 on the secondary slide. When there is a relative displacement of the secondary slide 30 in relation to the main slide 26, in which the secondary slide 30 moves rightwardly in relation to the main slide 26 which is assumed to be rigid, then the coil thrust spring 34*a* is unable to relax since the abutment flange 43*a* is bearing on the abutment head 39*a*. The projection 36 is therefore lifted off the end 45*a* of the sleeve 41*a*. On the other hand, the abutment flange 43*b* on the intermediate member 35*b* is lifted off the abutment head 39*b* of the pre-tension maintaing tie rod 37*b* and the abutment head 39*b* is displaced within the sleeve 41*b*. In this way, it is ensured that the full pre-tensioning force of the coil compression spring 34*b* is effective within the secondary slide 30 and the main slide 26, the pre-tensioning force increasing in keeping with the increasing compression of the coil thrust spring 34*b*. This is an advantageous modification in relation to the embodiment shown in FIG. 1 in which the spring forces of the coil thrust springs 34*a* and 34*b* are subtractively superimposed, so that the resultant transmission force of the coil thrust springs 34*a* and 34*b* is minimal. The considerable transmission force of the effective coil thrust spring 34*a*, 34*b* which is achieved in the embodiment shown in FIG. 6 is desirable in order that the wire or strip material can be pulled off the relevant supply roll, pulled through a possibly existing straightening appliance and in order to be able to accelerate the secondary slide 30 in accordance with the pattern of movements of the main slide 26.

Specific forms of embodiments of the invention have been shown and described for illustrating the use of the principles of the present invention. Of course the invention can be realized also in other ways without departing from these principles.

The reference numerals in the claims only serve to facilitate the understanding and are not to be understood as a limitation.

What is claimed is:

1. A material loading apparatus for material-working machines, comprising loading slide means guided in a main guide (28*a*) along a guidance direction (28) for stepwise conveying one of a wire and strip material with a controlled slide-mounted material clamping device (42, 48), an oscillating drive (10) which is connected to the loading slide means, and a controlled material holding device (54), stoppage of the slide-mounted material clamping device (42, 48) in its extreme positions along the main guide (28*a*) being determined by slide abutments (40*a*, 40*b*), a resilient transmission system (34*a*, 34*b*) provided in the driving connection between the oscillating drive (10) and the slide-mounted material clamping device (42, 48), said loading slide means comprising, connected to the oscillating drive (10), a main slide (26) which is guided in the main guide (28*a*), a secondary slide (30) guided on the main slide (26) substantially parallel to the guidance direction (28) of the main guide (28*a*), with said secondary slide (30) drivingly connected to the main slide (26) and carrying the slide-mounted material clamping device (42, 48), the secondary slide (30) cooperating with said slide abutments (40*a*, 40*b*), at least a part of the resilient transmission system (34*a*, 34*b*) being disposed between said secondary slide (30) and said main slide (26).

2. A material loading apparatus according to claim 1 characterized in that the mass of the secondary slide (30) is smaller than the mass of the main slide (26).

3. A material loading apparatus according to claim 1 characterized in that clamping control elements (90, 80) of a clamping control arrangement (50) for the slide-mounted material clamping device (42, 48) are mounted on the main slide (26), said clamping control elements (80, 90) acting onto said slide mounted material clamping device (42, 48) in response to relative movement of said secondary slide (30) and said main slide (26) along said guidance direction (28).

4. A material loading apparatus according to claim 3 characterized in that the slide-mounted material clamping device (42, 48) comprises a clamping station (42) rigid with the secondary slide, a clamping lever (44) mounted on the secondary slide (30) and a pressure-applying member (82, 147) which can be entrained along the main guide (28*a*) by the main slide (26) and which is adapted to act on the clamping lever (44) and is capable of relative movement vis-a-vis the clamping lever (44) and along the main guide (28*a*).

5. A material loading apparatus according to claim 1 characterized in that the secondary slide (30) is mounted on the main slide (26) between two transmission springs (34*a*, 34*b*) which act in opposite directions and parallel to said main guide (28*a*).

6. A material loading apparatus according to claim 5 characterized in that both transmission springs (34*a*, 34*b*) are combined with a respective pressure maintaining member (37*a*, 37*b*), both transmission springs (34*a*, 34*b*) being active only in a rest position of the secondary slide (30) with respect to the main slide (26), one of the transmission springs (34*a*, 34*b*) being inactivated in all other relative positions of the secondary slide (30) with respect to the main slide (26), with pressure of the respective inactivated transmission spring (34*a*, 34*b*) being maintained by the respective pressure maintaining member (37*a*, 37*b*).

7. A material loading apparatus according to claim 6 characterized in that the transmission springs are compression springs (34*a*, 34*b*), each of which is always supported on the main slide (26) and in the position of rest engages the secondary slide (30) via an associated intermediate member (35*a*, 35*b*) and in that furthermore there is on the main slide (26) for each compression spring (34*a*, 34*b*) a pretension-retaining armature (37*a*, 37*b*) which cooperates with the associated intermediate member (35*a*, 35*b*) through compression retaining abutments (39*a*, 43*a*; 39*b*, 43*b*) so that upon a relative displacement of the slides (26, 30) out of the position of rest and according to the direction of displacement, one intermediate member (35*a*, 35*b*) remains in abutting contact with the associated armature (37*a*, 37*b*), the pretension of the associated compression spring (34*a*, 34*b*) being maintained while the other intermediate member (35*b*, 35*a*) is displaced with mutual clearance of the associated compression-retaining abutments (39*a*, 43*a*; 39*b*, 43*b*), relative to the associated armature (37*b*, 37*a*), the associated compression spring (34*b*, 34*a*) undergoing increased compression.

8. A material loading apparatus according to claim 7 characterized in that the relevant intermediate member (35*a*, 35*b*) is constructed to have an intermediate sleeve (41*a*, 41*b*) one end (45*a*, 45*b*) of which engages the secondary slide (30), and displaceably accomodates an abutment head (39*a*, 39*b*) on the associated armature (37*a*, 37*b*), and in that an abutment flange (43*a*, 43*b*) is provided at the other end of the sleeve (41*a*, 41*b*) which engages behind said abutment head (39*a*, 39*b*) said abutment flange (43*a*, 43*b*) being disposed opposite the abutment head (39*a*, 39*b*) and subjected to the action of the associated compression spring (34*a*, 34*b*).

9. A material loading apparatus according to claim 7, in which the transmission springs are coil thrust springs.

10. A material loading apparatus for material-working machines, comprising loading slide means for stepwise conveying one of a wire and strip material with a controlled slide-mounted material clamping device (42, 48) mounted on the loading slide means for common movement therewith along a guidance direction (32), an oscillating drive (10) operatively connected to the loading slide means, and a controlled material holding device (54), stoppage of the loading slide means in at least one of its extreme positions along guidance direction (32) being determined by slide abutments (40*a*, 40*b*), the oscillating drive (10) causing movement of an oscillating drive member in a direction (28) substantially parallel to guidance direction (32), a resilient transmission system (34*a*, 34*b*) provided in driving connection between the oscillating drive member and loading slide means, the loading slide means having an abutment approach velocity prior to encountering respective slide abutments (40*a*, 40*b*), the abutment approach velocity being dependent upon a drive velocity of the oscillating drive member, a deceleration arrangement (64, 70; 74; 78) operatively connected to the loading slide means for slowing the approach velocity of the loading slide means with respect to the drive velocity of the oscillating slide member in response to the loading slide means approaching the respective slide abutment (40*a*, 40*b*) prior to the loading slide means encountering the respective slide abutment (40*a*, 40*b*), the oscillating drive member being a main slide (26) guided by a main guide (28*a*) along the guidance direction (28), the loading slide means comprising a secondary slide (30) provided on the main slide (26) and guided thereon in a secondary guidance direction (32) parallel to guidance direction (28), the oscillating drive (10) being operatively connected to the main slide (26), the resilient transmission system (34*a*, 34*b*) being provided in driving connection between the main slide (26) and the secondary slide (30), the secondary slide (30) cooperating with the slide abutments (40*a*, 40*b*), the deceleration arrangement (64, 70; 74, 78) slowing the approach velocity of the secondary slide (30) with respect to the drive velocity of the main slide (26), the slide-mounted material clamping device (42, 48) being mounted on the secondary slide (30) for common movement therewith.

11. A material loading apparatus according to claim 10 characterized in that for braking the secondary slide (30), a proximity sensor (68, 76) is provided which enters into reciprocal action with a sensor engaging surface (70, 78) which is rigid with a slide abutment when the secondary slide (30) draws close to the slide abutment (40*a*, 40*b*) and in that this proximity sensor (68, 76) acts on the secondary slide (30), braking its speed of approach to the relevant abutment (40*a*, 40*b*).

12. A material loading apparatus according to claim 11 characterized in that the proximity sensor (68, 76) acts on the secondary slide (30) via a sensor transmission (64, 72) supported on the main slide (26).

13. A material loading apparatus according to claim 12 characterized in that the proximity sensor (68, 76) is mounted on one arm (64*b*, 72*b*) of an angled lever (64, 72) which is pivotally mounted on the main slide (26) and in that a further arm (64*a*, 72*a*) of said angled lever (64, 72) acts on the secondary slide (30).

14. A material loading apparatus according to claim 11 characterized in that the engaging surface (70, 78) which is rigid with the abutment is inclined at an acute angle to the direction of guidance (28) of the main guide (28*a*).

15. A material loading apparatus according to claim 11 characterized in that a proximity sensor (68, 72) is associated with each of the slide abutments (40*a*, 40*b*).

16. A material loading apparatus according to claim 11 characterized in that the sensor engaging surface (70, 78) is immovably connected to the relevant slide abutment (40*a*, 40*b*) by a respective connecting member (122, 124).

17. A material loading apparatus according to claims 1 or 10 characterized in that control of the slide-mounted clamping device (42, 48) is derived from a relative follow-up movement of the main slide (26) in relation to the secondary slide (30), taking place when the secondary slide (30) strikes the relevant slide abutment (40*a*, 40*b*), and for controlling the material clamping device (42, 48), a clamping wedge (82) is disposed between a clamping lever (44) of the clamping device (42, 48), mounted on the secondary slide (30), and a wedge engagement surface (84) which is provided on the secondary slide (30), said clamping wedge cooperating with wedge actuating abutments (80, 90) on the main slide (26), said wedge actuating abutments engaging said clamping wedge in the direction of guidance (28) of said main guide (28*a*).

18. A material loading apparatus according to claim 17 characterized in that at least the one (90) of said wedge actuating abutments (80, 90) which causes clamping of the slide-mounted clamping device (42, 48) is spring-mounted.

19. A material loading apparatus according to claims 1 or 10 characterized in that the material holding device (54) is controlled by relative follow-up movements of the main slide (26) in relation to the secondary slide (30) which occur when the secondary slide (30) strikes a respective slide abutment (40*a*, 40*b*), and the main slide (26) comprises at least one holding device controlling abutment (94, 118) which acts on a holding device controlling transmission (100).

20. A material loading apparatus according to claim 19 characterized in that the main slide (26) comprises two holding device controlling abutments (94, 118), either one of which acts in opposite direction on the holding device controlling transmission (100) depending on the direction of movement of said main slide (26).

21. A material loading apparatus according to claim 20 characterized in that the holding device controlling transmission (100) comprises a linkage (100) with linkage abutments (98, 120) extending in the direction of guidance (28) of said main guide and being subject to the action of the holding device controlling abutments (94, 118).

22. A material loading apparatus according to claim 21 characterized in that the slide abutments (40*a*, 40*b*) are connected to adjusting abutment faces (126, 128) which serve the adjustment of the linkage abutments (98, 120).

23. A material loading apparatus according to claim 20 characterized in that the holding device controlling transmission (100) acts on the material holding device (54) via a clamping wedge device (108, 110).

24. A material loading apparatus for material-working machines, comprising loading slide means for stepwise conveying one of a wire and strip material with a controlled slide-mounted material clamping device (42, 48) mounted on the loading slide means for common movement therewith along a guidance direction (32), an oscillating drive (10) operatively connected to the loading slide means, and a controlled material holding device (54), stoppage of the loading slide means in at least one of its extreme positions along guidance direction (32) being determined by slide abutments (40*a*, 40*b*), the oscillating drive (10) causing movement of an oscillating drive member in a direction (28) substantially parallel to the guidance direction (32), a resilient transmission system (34*a*, 34*b*) provided in driving connection between the oscillating drive member and loading slide means, the loading slide means having an abutment approach velocity prior to encountering the respective slide abutment (40*a*, 40*b*), said abutment approach velocity being dependent on a drive velocity of the oscillating drive member, a deceleration arrangement (64, 70; 74, 78) operatively connected to the loading slide means for slowing the approach velocity of the loading slide means with respect to the drive velocity of the oscillating drive member in response to the loading slide means approaching the respective slide abutment (40*a*, 40*b*) prior to the loading slide means encountering the respective slide abutment (40*a*, 40*b*).

25. A material loading apparatus according to any one of claims 1, 10, or 24 characterized in that at least one of the slide abutments (40*a*, 40*b*) is provided with lockable adjusting means (40*a*1, 40*b*1) in the direction of guidance (28) of the main guide (28*a*).

26. A material loading apparatus according to any one of claims 1, 10, or 24 characterized in that the material clamping device (42, 48) and the material holding device (54) are controlled by multiply dependent control means (80, 90, 82; 94, 98, 118, 100, 108, 110) effecting a clamping action of at least one of said material clamping device (40, 48) and said material holding device (54) at all times during operation.

27. A material loading apparatus according to any one of claims 1, 10, or 24, wherein the apparatus is employed in combination with an automatic wire and strip stamping and bending machine.

* * * * *